US005199624A

United States Patent [19]

Smart et al.

[11] Patent Number: 5,199,624

[45] Date of Patent: Apr. 6, 1993

[54] TABLE TOP RIVET SETTING ASSEMBLY

[75] Inventors: Charles F. Smart, Danbury; William E. O'Connor, Watertown; Anthony D'Aquila, Trumbull, all of Conn.

[73] Assignee: Emhart Inc., Newark, Del.

[21] Appl. No.: 630,904

[22] Filed: Dec. 20, 1990

[51] Int. Cl.[5] ..... B21J 15/28

[52] U.S. Cl. ..... 227/2; 227/51

[58] Field of Search ..... 227/2, 55, 56, 57, 53, 227/51, 52, 54, 58, 60; 29/709, 710, 713

[56] References Cited

U.S. PATENT DOCUMENTS 4,205,547 6/1980 Yamasaka ..... 227/51 X
4,515,302 5/1985 Davern et al. ..... 227/51 X
4,643,344 2/1987 Kaita et al. ..... 227/52 X
4,747,294 5/1988 Schwartz et al. ..... 227/51 X
4,901,431 2/1990 Gast ..... 227/2 X
4,988,028 1/1991 Smart et al. ..... 226/53 X
5,009,354 4/1991 D'Aquila et al. ..... 227/3 X

*Primary Examiner*—Frank T. Yost
*Assistant Examiner*—Rinaldi Rada
*Attorney, Agent, or Firm*—Spencer T. Smith

[57] ABSTRACT

A rivet pulling head is supported for vertical displacement from an up position to a down riveting position. A rivet delivery device is carried by a movable support and has a delivery arm which can be lowered relative to the pulling head and pivoted underneath it to deliver the next rivet to the pulling head. The delivery device is operated when the head is at the up position and while the head is maintained at that location.

3 Claims, 2 Drawing Sheets

TABLE TOP RIVET SETTING ASSEMBLY

Figure 1:
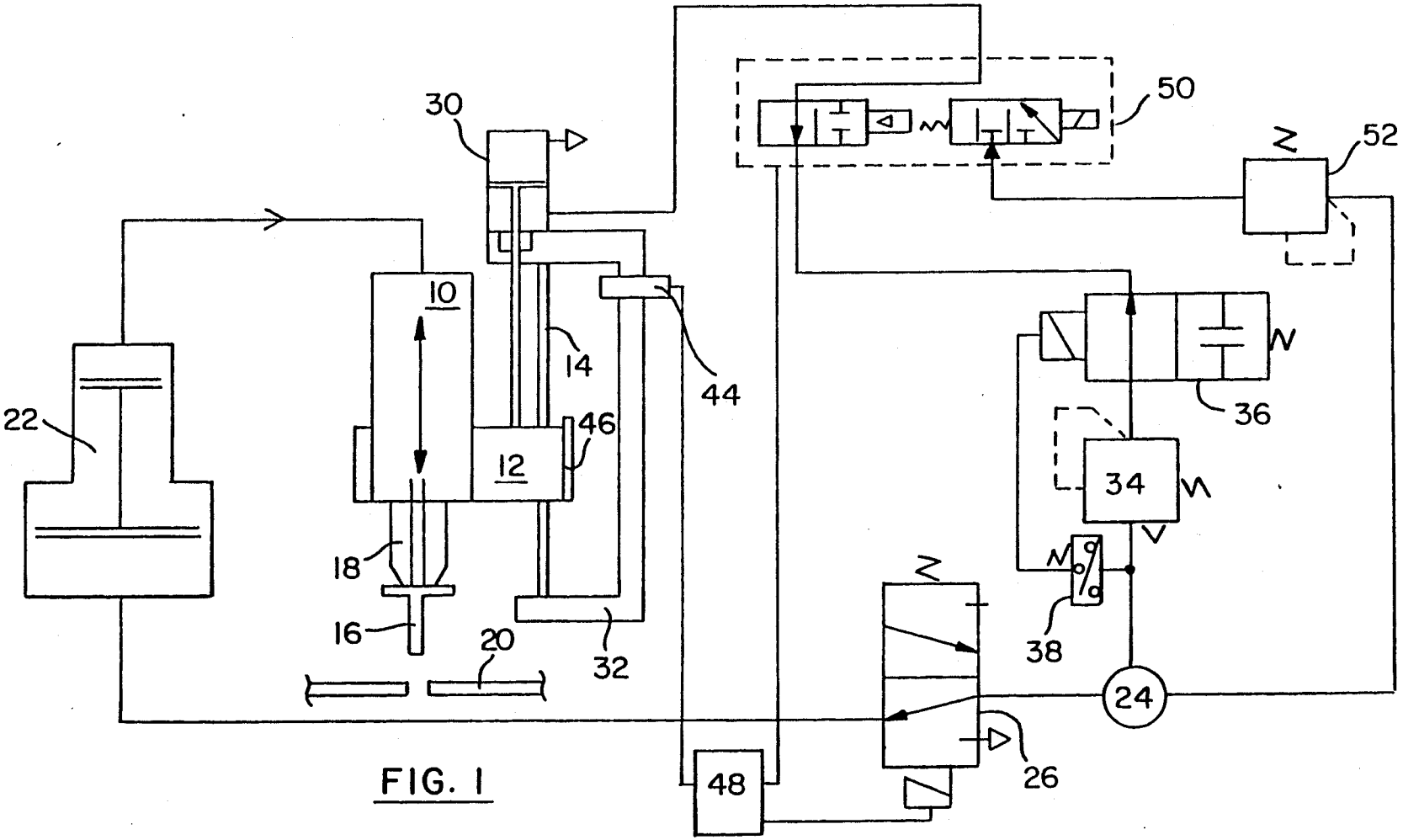

The present invention relates to table top rivet setting tool assemblies.

Table-top rivet setting tool assemblies include a pulling head which is secured to a vertically displaceable support so that an operator can lower the pulling head to the top of the table to set a rivet in a product supported on the table and so that the operator can raise the pulling head to an elevated position which is high enough so that a rivet delivery device which extends downwardly below the pulling head to transfer the next rivet to the pulling head will have sufficient room in which to operate.

It is accordingly an object of the present invention to assure that rivet transfer is completed before the operator lowers the pulling head so that the rivet delivery device will not be subject to damage.

Other objects and advantages of the present invention will become apparent from the following portion of the specification and from the accompanying drawings, which illustrate, in accordance with the mandate of the patent statutes, a presently preferred embodiment of the invention.

Figure 2:
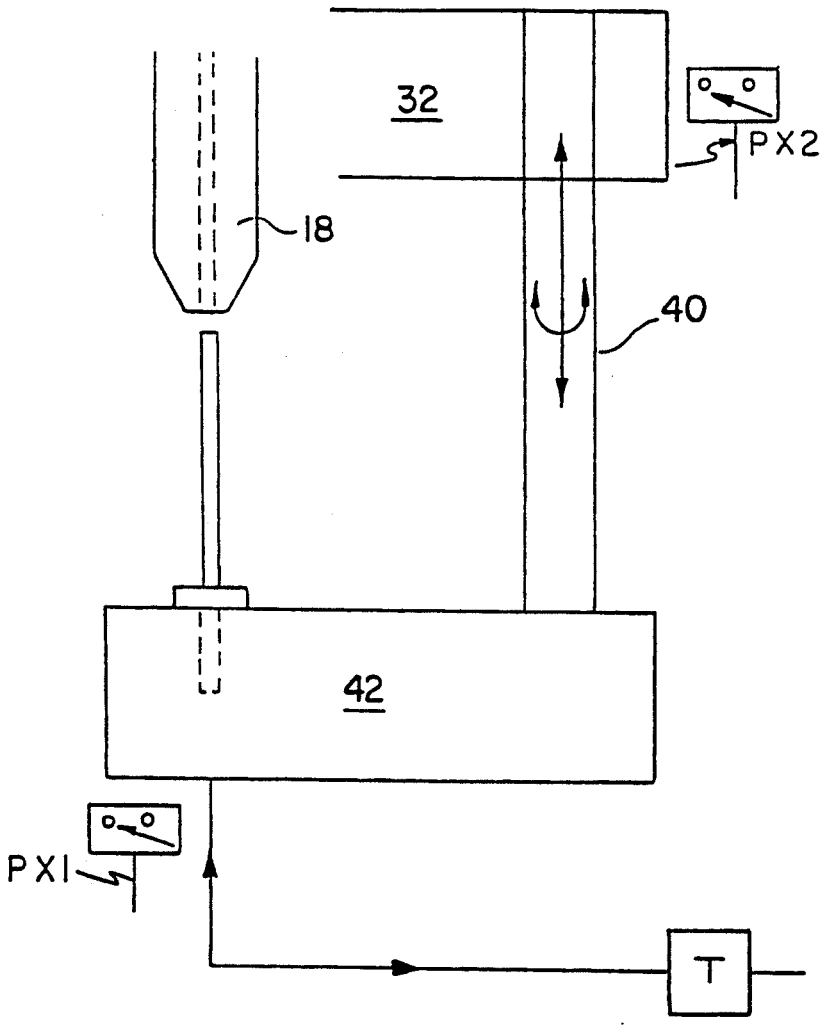

Referring to the drawings:

FIG. 1 is a schematic representation of a table top rivet setting tool assembly made in accordance with the teachings of the present invention, and FIG. 2 is a schematic illustration of the rivet delivery device for transferring rivets to the pulling head shown in FIG. 1.

The rivet setting pulling head 10 of a rivet setting tool is secured to a support bracket 12 which is vertically displaceable up and down a guide rod or rods 14. The pulling head can be lowered to set or fasten a rivet 16 held in the nose 18 of the pulling head in a workpiece 20. The pulling head is operated by a hydraulic/-pneumatic intensifier 22 which intensifies the pressure of air supplied from a conventional source 24. The operation of the intensifier is controlled by a first pneumatic solenoid valve 26.

The weight of the pulling head 10, handle assembly 11 and bracket 12 are counterbalanced by a double acting cylinder 30 (or more than one) which is secured to the assembly frame 32 and is connected to the support bracket 12. Air under pressure is supplied from the source 24 through a first precision pressure regulator 34 to the bottom of the cylinder 30 and is adjusted to counterbalance the system. Failsafe operation is assured by use of a second normally closed, two way, spring return solenoid valve 36 which will close, locking the movement of the cylinder whenever power is lost or pressure switch 38 senses a loss of pressure.

When the rivet setting tool is to be operated, the controller 48 will open the first pneumatic cylinder 26 to operate the pulling head.

To assure that the pulling head 10 will be properly elevated when the axially advanceable shaft 40 of the rivet delivery device is vertically lowered from its elevated position to the illustrated down position while the nesting bushing 42 secured there to is pivoted bringing the next rivet 16 into coaxial alignment with the nose of the rivet pulling head 10, a proximity switch 44 operates with an adjustable target 46 to signal the controller 48 when the pulling head is at the fully up, rivet transfer position.

The controller will actuate a three way normally closed quick exhaust valve 50 to disconnect the second solenoid valve 36 and to connect the air supply 24 via a third pressure regulator 52 which defines a much higher pressure than the first regulator 34 to the bottom of the double acting cylinder 30 to hold the cylinder and hence the pulling head at the up position during rivet delivery. When a rivet is transferred from the nesting bushing 42 to the pulling head 18 vacuum switch PX1 will sense the rivets transfer and will start a timer T. When the timer times out after for example 3/10 of a second which is long enough for the nesting bushing to be pivoted away from the nose and returned to its retracted position, the controller turns off the three way normally closed quick exhaust valve 50 again enabling the downward counterbalanced displacement of the pulling head. Where the nesting bushing 42 is pivoted conjointly with the displacement of the rivet delivery device from the down position to the up position (shown in the dotted lines) a signal from a proximity switch PX2 which senses the nesting bushing at the up position can optionally be used to control the turning off of the three way valve 50.

We claim:

1. A table top rivet setting assembly comprising
   a pulling head for setting a rivet,
   means for supporting said pulling head for vertical displacement from an up position to a down riveting position,
   rivet delivery means for holding a rivet
   said rivet delivery means being vertically displaceable from a retracted position relative to said pulling head to an advanced position beneath said pulling head whereat the rivet can be transferred to said pulling head and returning said rivet delivery means from said advanced position to said retracted position,
   means for preventing the downward displacement of said supporting means,
   means for operating said preventing means when said supporting means is at said up position including means for sensing that said supporting means is at said up position, and
   means for disabling said operating means following the displacement of said rivet delivery means from said retracted position down to said advanced position and back up to said retracted position.

2. A table top rivet setting assembly according to claim 1, wherein said disabling means comprises
   means for determining that a rivet held by said rivet delivery means has been transferred to said pulling head and
   timing means operable when said determining means determines that a rivet has been transferred,
   said timing means being selectably settable to a time period corresponding to the time it takes for said rivet delivery means to return to said retracted position following transfer of the rivet to said pulling head.

3. A table top rivet setting assembly according to claim 1, comprising
   a two way cylinder,
   first pressure applying means for applying a first pressure to the top of said cylinder,
   second pressure applying means for applying a second pressure to the bottom of said cylinder selected to counterbalance said supporting means,
   third pressure means for applying a third pressure to the bottom of said cylinder substantially greater than said second pressure, and
   said preventing means comprising means for connecting said third pressure means to the bottom of said cylinder.

* * * * *